US006662485B2

(12) United States Patent
Kay

(10) Patent No.: US 6,662,485 B2
(45) Date of Patent: Dec. 16, 2003

(54) FIREARM INTERFACE FOR A BUTTSTOCK AND PISTOL GRIP

(76) Inventor: Ira Kay, 405 Winchester St., Warrenton, VA (US) 20186

( * ) Notice: Subject to any disclaimer, the term of this patent is extended or adjusted under 35 U.S.C. 154(b) by 0 days.

(21) Appl. No.: 10/066,259

(22) Filed: Jan. 31, 2002

(65) Prior Publication Data

US 2003/0140542 A1 Jul. 31, 2003

(51) Int. Cl.[7] ..... F41C 11/00
(52) U.S. Cl. ..... 42/75.03
(58) Field of Search ..... 42/75.03, 71.01, 42/72, 75.01; 224/150

(56) References Cited

U.S. PATENT DOCUMENTS

| | | | | | |
|---|---|---|---|---|---|
| 1,755,034 | A | * | 4/1930 | Stange | 42/75.03 |
| 3,323,246 | A | * | 6/1967 | Loffler | 42/75.01 |
| 3,348,328 | A | | 10/1967 | Roy | 42/73 |
| 3,618,248 | A | | 11/1971 | Into et al. | 42/71 R |
| 4,512,101 | A | | 4/1985 | Waterman | 42/71 R |
| 5,173,564 | A | * | 12/1992 | Hammond, Jr. | 42/75.03 |
| 5,303,859 | A | * | 4/1994 | Jenkin | 224/149 |
| 5,907,918 | A | | 6/1999 | Langevin et al. | 42/71.01 |
| 5,946,842 | A | * | 9/1999 | Nyzell | 42/72 |
| 6,260,748 | B1 | * | 7/2001 | Lindsey | 224/150 |
| 6,374,528 | B1 | * | 4/2002 | Davis et al. | 42/71.01 |
| 6,591,533 | B2 | * | 7/2003 | Wygant | 42/72 |

FOREIGN PATENT DOCUMENTS

| | | | | | |
|---|---|---|---|---|---|
| FR | 2581745 | A1 | * | 11/1986 | F41A/3/72 |
| GB | 2026659 | A | * | 2/1980 | F41C/23/00 |

* cited by examiner

*Primary Examiner*—Michael J. Carone
*Assistant Examiner*—Denise Buckley
(74) *Attorney, Agent, or Firm*—Shlesinger, Arkwright & Garvey LLP

(57) ABSTRACT

A firearm interface for a buttstock and pistol grip that provides a means to attach a pistol grip or a buttstock assembly to a firearm, and shotguns in particular. It can be used for either modality individually or both in combination. It allows the utilization of an M16/M4 style pistol grip and the adjustable, as well as the fixed buttstocks of M4/M16 style rifles and carbines. The buttstock and pistol grip interface confers the ability to configure the firearm to different requirements and to the ergonometric needs of diverse individuals. By facilitating the use of M4/M16 style receiver extensions and M16/M4 style pistol grips the buttstock and pistol grip interface brings a vast array of options to the firearms to which it is affixed. For those individuals with military experience the use of M16/M4 style components imparts a degree of familiarity and utility.

16 Claims, 6 Drawing Sheets

FIREARM INTERFACE FOR A BUTTSTOCK AND PISTOL GRIP

BACKGROUND

1. Field of the Invention

This invention relates generally to the field of firearms, and more particularly to a firearm interface for a buttstock and pistol grip which can accept fixed as well as adjustable style buttstocks and pistol grips separately or in combination. The invention allows the use of a M4/M16 or variant style of buttstock and pistol grips to be used with the firearm to which it is affixed.

BACKGROUND

2. Description of Prior Art

Heretofore firearms, and shotguns in particular have utilized various styles of stocks, buttstock, and forends. The principal use of the firearm has dictated the design of these components. The ability to modularize a firearm has been largely unaddressed within the manufacture.

U.S. Pat. No. 3,348,328 to Robert Earl Roy (Oct. 24, 1967) discloses a receiver extension rod for firearms with an elongated rib extending radially outward and a buttstock assembly which can be adjusted in length for individuals of different size. This buttstock has heretofore been confined to its use on M4 style carbines and variants thereof firearms.

U.S. Pat. No. 3,618,248 to Henry A. Into, and John K. Jorczak (Nov. 9, 1971) disclose a buttstock assembly for a firearm with a cylindrical receiver extension of, and a buttstock that provides for an internal storage compartment. This buttstock has heretofore been confined to its use on M16 style rifles and variants thereof.

U.S. Pat. No. 4,512,101 to Harold J. Waterman Jr. (Apr. 23, 1985) discloses a buttstock similar to that described in U.S. Pat. No. 3,618,248 with an increase in strength from improved construction. This patent has similarly been confined to M16 style rifles and variants thereof.

The ability to configure firearms for specific needs and egonometrics for the user has largely been unaddressed, and specifically for shotguns.

OBJECTS AND ADVANTAGES

Accordingly, several objects and advantages of my invention are to provide the option of a fixed buttstock of the style utilized on M16 firearms and variants thereof, as well as the optional addition of a pistol grip for a firearm.

Still further objects and advantages will become apparent from a consideration of the ensuing description and accompanying drawings. They depict the abiltiy to utilize an adjustable buttstock of the style used by M4 firearms and variants thereof, as well as the optional addition of a pistol grip for a firearm.

A further object of the invention is to allow the use of a pistol grip upon a firearm.

Yet another object of the present invention is to allow the use of an M16 style firearm or variant thereof buttstock that provides an internal storage compartment for use on firearms.

Still another object of the present invention is to provide for optional configurations and modularity for firearms.

Still further objects and advantages will become apparent from a consideration of the ensuing description and accompanying drawings

SUMMARY

A firearm interface for a buttstock and pistol grip that provides a means to attach a pistol grip or a buttstock assembly to a firearm, and shotgun in particular. It can be utilized for either a buttstock or a pistol grip individually or both in combination. The firearm interface allows for the use of M16/M4 style buttstock of the adjustable, and fixed with internal stowage type, as well as a pistol grip. The firearm interface for a buttstock and pistol grip confers the ability to configure a firearm for diverse requirements and differing ergonometric needs of individuals. By facilitating the use of M4/M16 style receiver extensions and M16/M4 style pistol grips, this invention brings a vast array of options to the firearms to which it is affixed. For those with military experience the use of M4/M16 components brings a level of familiarity and utility.

REFERENCE NUMERALS

Figure 1:
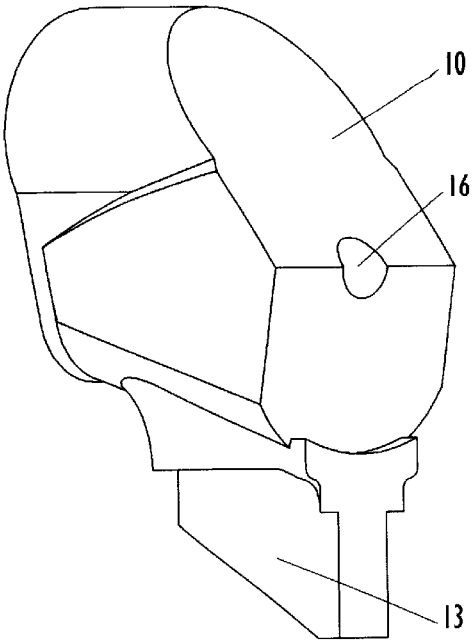
FIG. 1 is a front perspective of the buttstock and pistol grip interface of the preferred embodiment of the present invention.

10 buttstock and pistol grip interface
13 pistol grip mounting flange
15 threaded bore
16 fastening bore
18 fastener counterbore
20 fastener
22 pistol grip
24 receiver extension threaded bore
26 receiver endplate
28 adjustable receiver extension locknut
30 adjustable receiver extension
32 adjustable buttstock
34 adjustable buttstock assembly
36 pistol grip fastener
38 fixed buttstock assembly
40 tubular receiver extension
42 fixed buttstock body
44 shotgun receiver
46 shotgun assembly
48 adjustment lever
50 locating pin
52 locating pin nut
54 locating pin spring
56 upper buttplate fastener
58 buttplate
60 lower buttplate fastener
62 sling swivel
64 elongated rib

SUMMARY

A firearm interface for a buttstock and pistol grip that provides a means to attach a pistol grip or a buttstock assembly to a firearm, and shotguns in particular. It can be utilized for either a buttstock or a pistol grip individually or both in combination. The firearm interface allows for the use of M16/M4 style buttstocks of the adjustable, and fixed with internal stowage type, as well as a pistol grip. The firearm interface for a buttstock and pistol grip confers the ability to configure a firearm for diverse requirements and differing ergonometric needs of individuals. By facilitating the use of M4/M16 style receiver extensions and M16/M4 style pistol grips this invention brings a vast array of options to the firearms to which it is affixed. For those with military experience the use of M4/M16 style components brings a level of familiarity and utility.

DETAILED DESCRIPTION OF THE INVENTION

Figure 2:
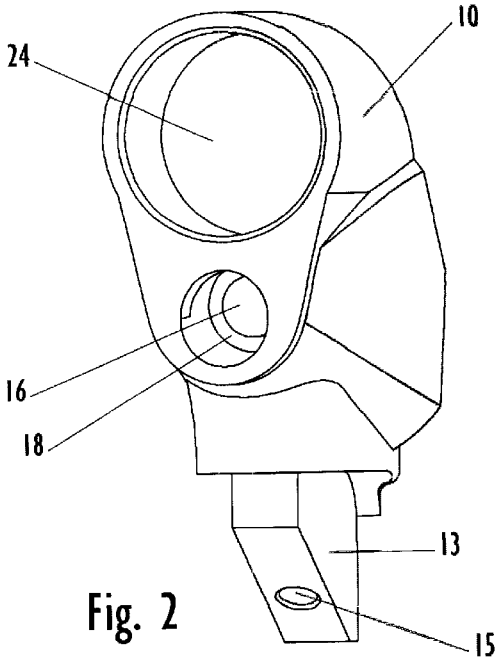
FIG. 2 is a back perspective view according to a preferred embodiment of my invention.
Figure 3:
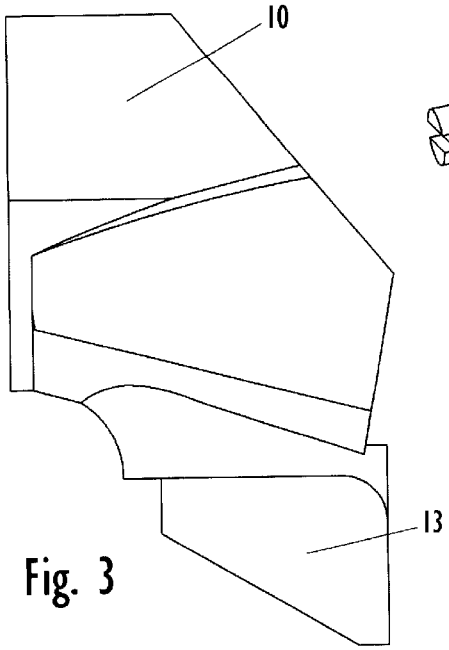
FIG. 3 is a side view according to a preferred embodiment of my invention.
Figure 5:
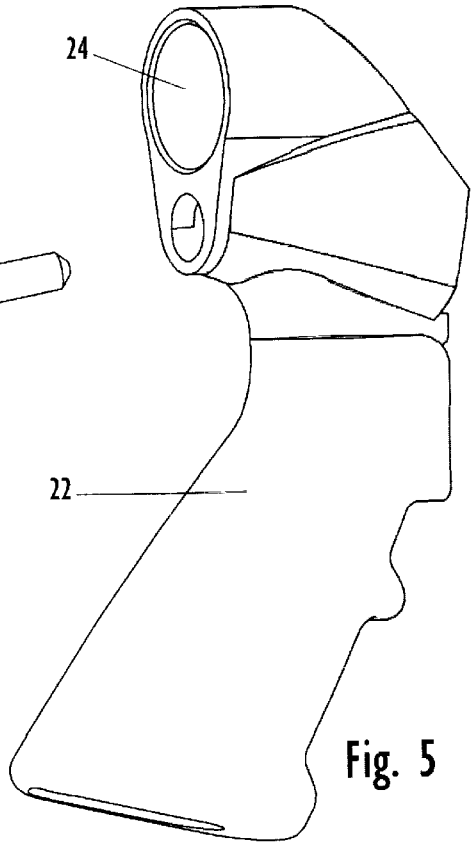
FIG. 5 is a back perspective view of a buttstock and pistol grip interface and pistol grip according to a preferred embodiment of my invention.
Figure 6:
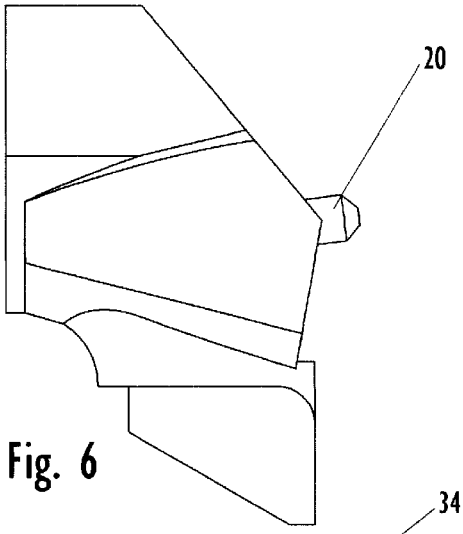
FIG. 6 is a side view of a buttstock and pistol grip interface and fastener assembly according to a preferred embodiment of my invention.
Figure 7:
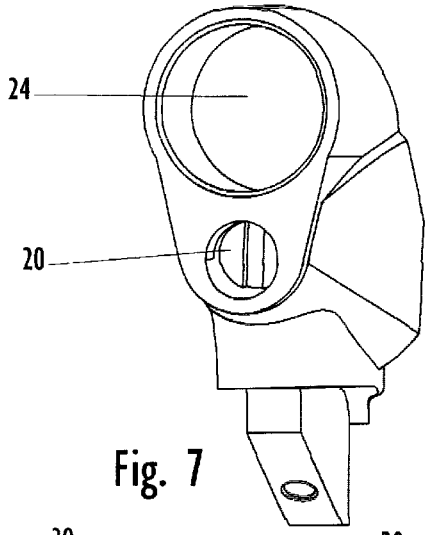
FIG. 7 is a is a back perspective view of a buttstock and pistol grip interface and fastener assembly according to a preferred embodiment of my invention.
Figure 8:
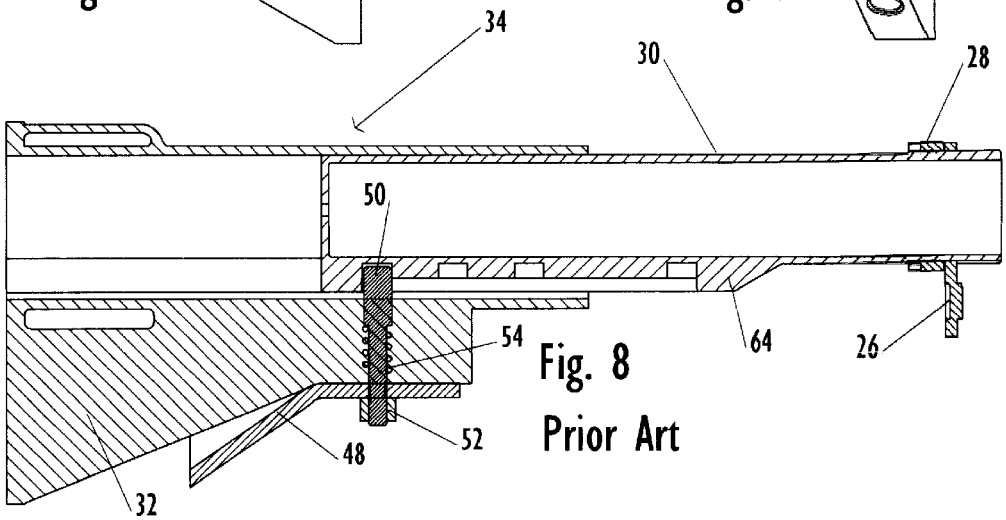
Fig. 8 Prior Art
FIG. 8 is a is a cross-sectional side view of an adjustable buttstock assembly as described in U.S. Pat. No. 3,348,328.

FIGS. 1–3 show the preferred embodiment of the present invention, a buttstock and pistol grip interface 10 from front perspective, back perspective, and side views respectively. A pistol grip mounting flange 13 is shown, which has a threaded bore 15 to allow for a pistol grip 22 to be threadably attached to buttstock and pistol grip interface 10. Shown in FIG. 2 is a fastening bore 16 through which a fastener 20 shown in FIG. 4 can pass and secure buttstock and pistol grip interface 10 to rear of a shotgun receiver threadably. A fastener counterbore 18 is shown which provides a stop for a said fastener. FIGS. 2, 5, and 7 show back perspective views of their respective figures, and receiver extension threaded bore 24. FIG. 6 and FIG. 7 show a side and back perspective view of buttstock and pistol grip interface 10 with fastener 20 inserted. FIG. 8 shows a adjustable buttstock assembly 34 in a cross-sectional side view. It is described in detail in U.S. Pat. No. 3,348,328 and representative of the style of buttstock assembly employed by M4/M16 style carbines and rifles. Shown are adjustable receiver extension 30, adjustable buttstock 32, adjustable receiver extension locknut 28, receiver endplate 26, adjustment lever 48, locating pin 50, locating pin nut 52, elongated rib 64, and locating pin spring 54.

Figure 9:
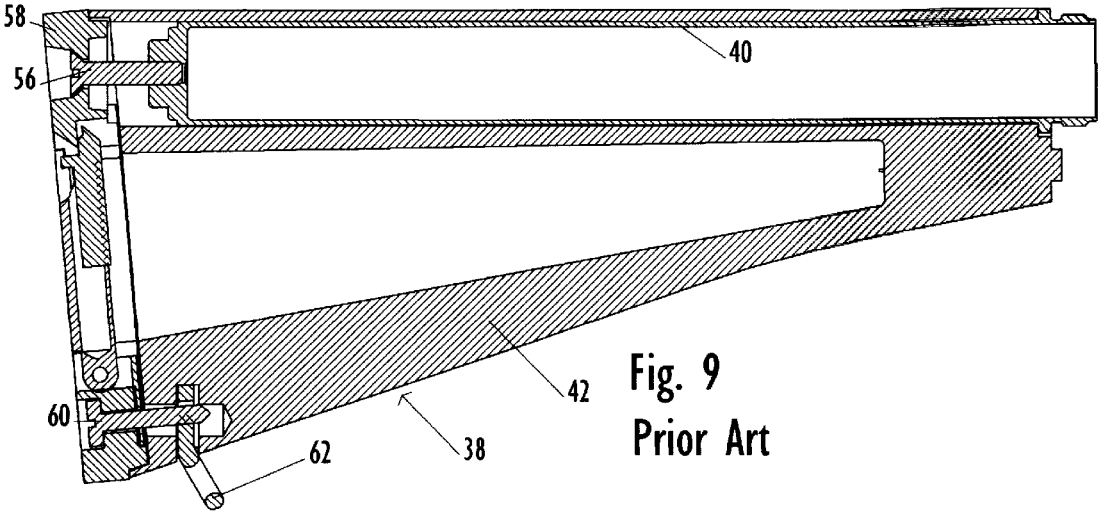
Fig. 9 Prior Art
FIG. 9 is a cross-sectional side view of a buttstock assembly with a latchable door for a compartment formed therein as described in U.S. Pat. No. 3,618,248.
Figure 10:
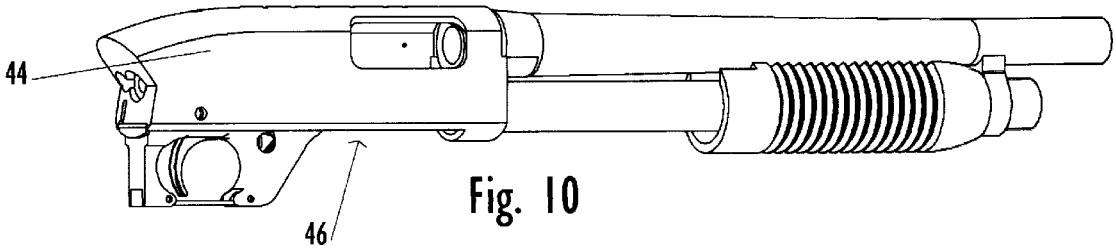
FIG. 10 is a a perspective view of a shotgun without a buttstock.
Figure 11:
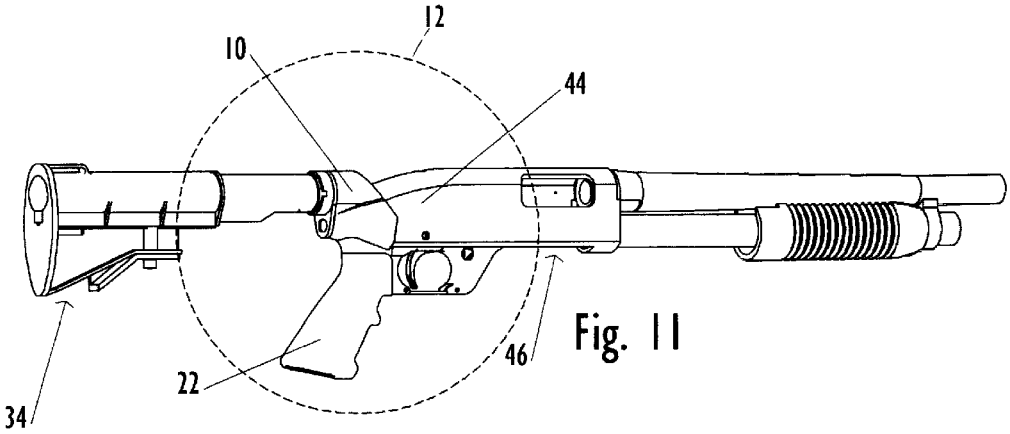
FIG. 11 is a perspective view of the buttstock and pistol grip adapter according to a preferred embodiment of my invention attached to the back of a shotgun with an adjustable buttstock assembly and pistol grip fastened to it.
Figure 12:
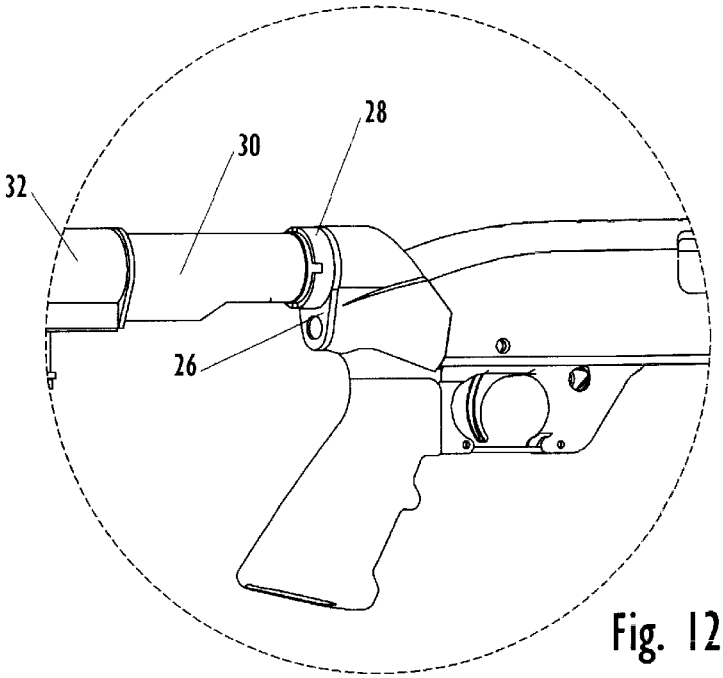
FIG. 12 is a detail view of reference number 12 in FIG. 11.

FIG. 9 shows a cross-sectional side view of a fixed buttstock assembly 38. Said buttstock assembly contains a latchable door for a compartment formed therein and is described in detail U.S. Pat. No. 3,618,248 and representative of a style of fixed buttstock utilized by M16/M4 style rifles and carbines. Key elements of the figure are tubular receiver extension 40, fixed buttstock body 42, upper buttplate fastener 56, buttplate 58, lower buttplate fastener 60, and sling swivel 62. FIG. 10 represents a typical shotgun without a buttstock attached to the back of the shotgun receiver 44. For descriptive purposes it is referenced as a shotgun assembly 46. FIG. 11 is a perspective view of a shotgun assembly 46 with buttstock and pistol grip interface 10 attached to the back of shotgun receiver 44 with a pistol grip 22 attached to pistol grip mounting flange 13 (not shown) and an adjustable buttstock assembly 34 threadably attached to receiver extension threaded bore 24 (not shown). FIG. 12 is a detail view of section 12 of FIG. 11. Shown is receiver endplate 26, adjustable receiver extension locknut 28, adjustable receiver extension 30, and adjustable buttstock 32, which are components of adjustable buttstock assembly 34 shown in FIG. 11.

Figure 13:
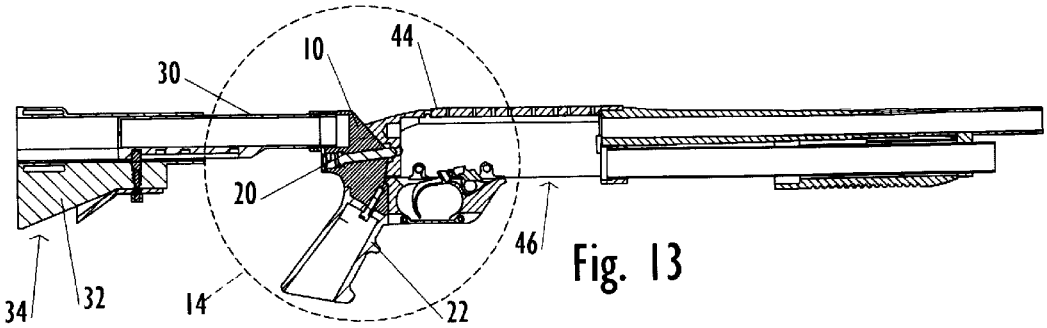
FIG. 13 is a is a cross-sectional side view of a shotgun with a buttstock and pistol grip interface according to a preferred embodiment of my invention and adjustable buttstock assembly and pistol grip.
Figure 14:
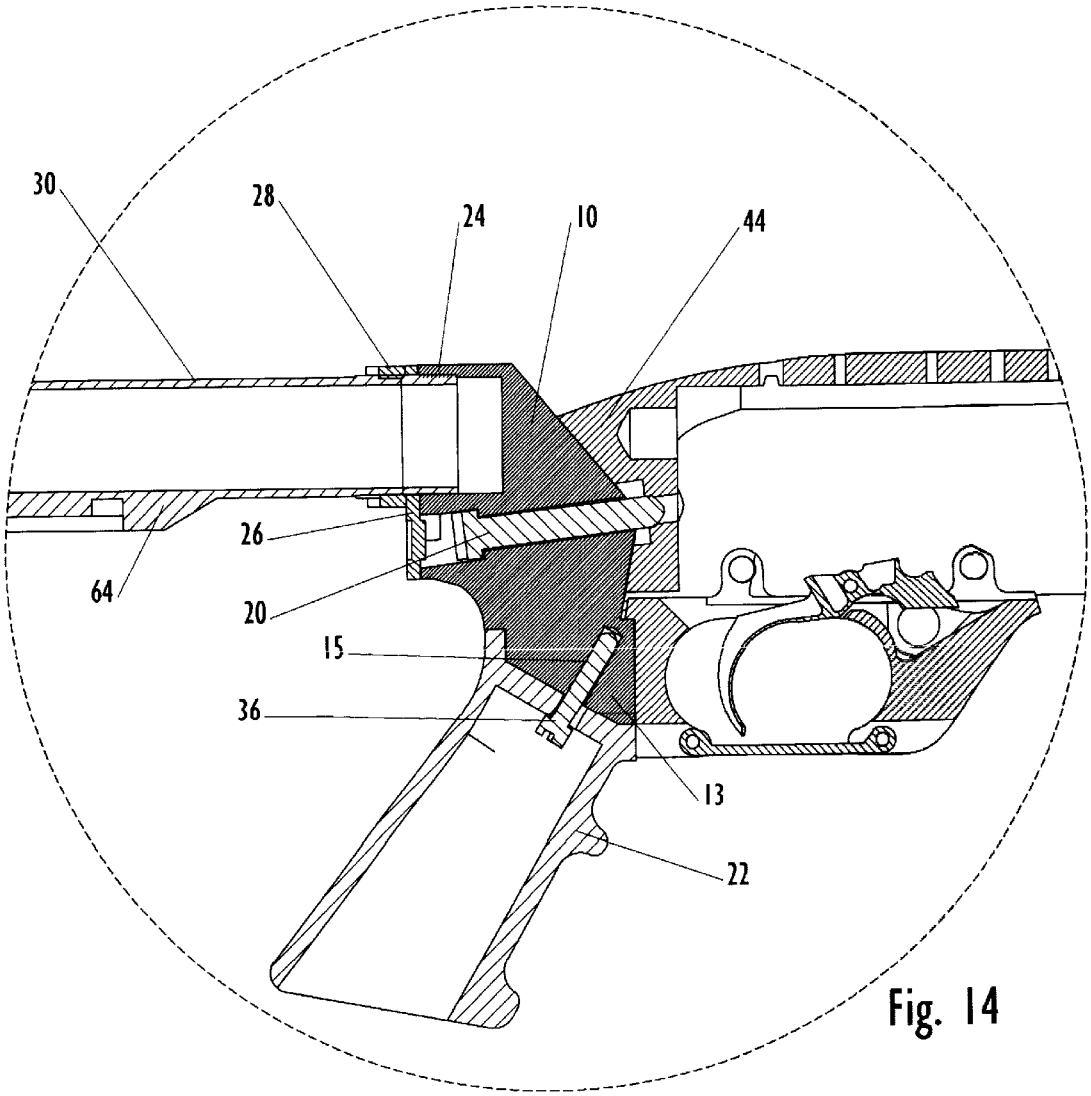
FIG. 14 is a view in detail of a section of FIG. 13 indicated by reference number 14.

FIGS. 13 and 14 show a side cross-sectional views of a shotgun assembly 46 with buttstock and pistol grip interface 10, adjustable buttstock assembly 34, and a pistol grip 22. FIG. 14 shows detail view 14 of FIG. 13. FIG. 13 shows buttstock and pistol grip interface 10 threadably attached by fastener 20 to the back surface of shotgun receiver 44. Attached to buttstock and pistol grip interface 10 is pistol grip 22 which is connected to pistol grip mounting flange 13 by pistol grip fastener 36 which is threadably inserted within threaded bore 15. FIG. 14 shows adjustable receiver extension 30 which is threadably inserted within receiver extension threaded bore 24. Adjustable receiver extension 30 is tubular in shape with an elongated rib 64 which extends radially outward from its bottom surface. Approximating the back surface of buttstock and pistol grip interface 10, is receiver endplate 26, secured by adjustable receiver extension locknut 28 that is threadably attached to the front surface of adjustable receiver extension 30. FIG. 11 shows adjustable buttstock 32 that is slidably inserted upon adjustable receiver extension 30.

Figure 15:
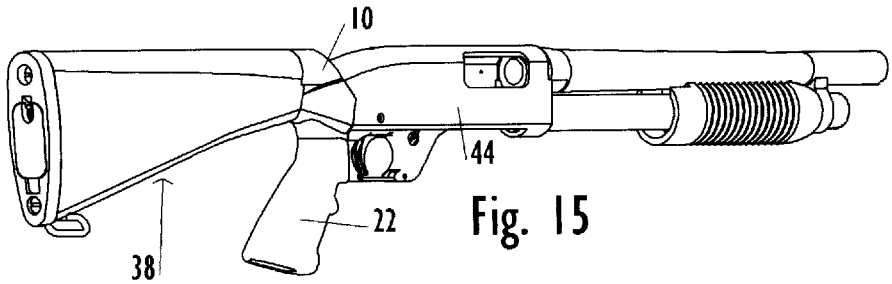
FIG. 15 is a a perspective view of my invention attached to a shotgun with a fixed buttstock assembly and pistol grip fastened to it.
Figure 16:
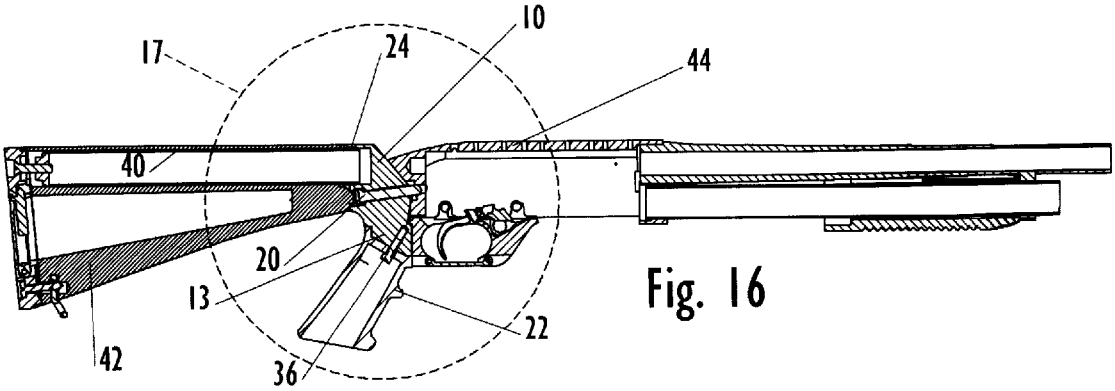
FIG. 16 is a cross-sectional side view of the shotgun in FIG. 15.
Figure 17:
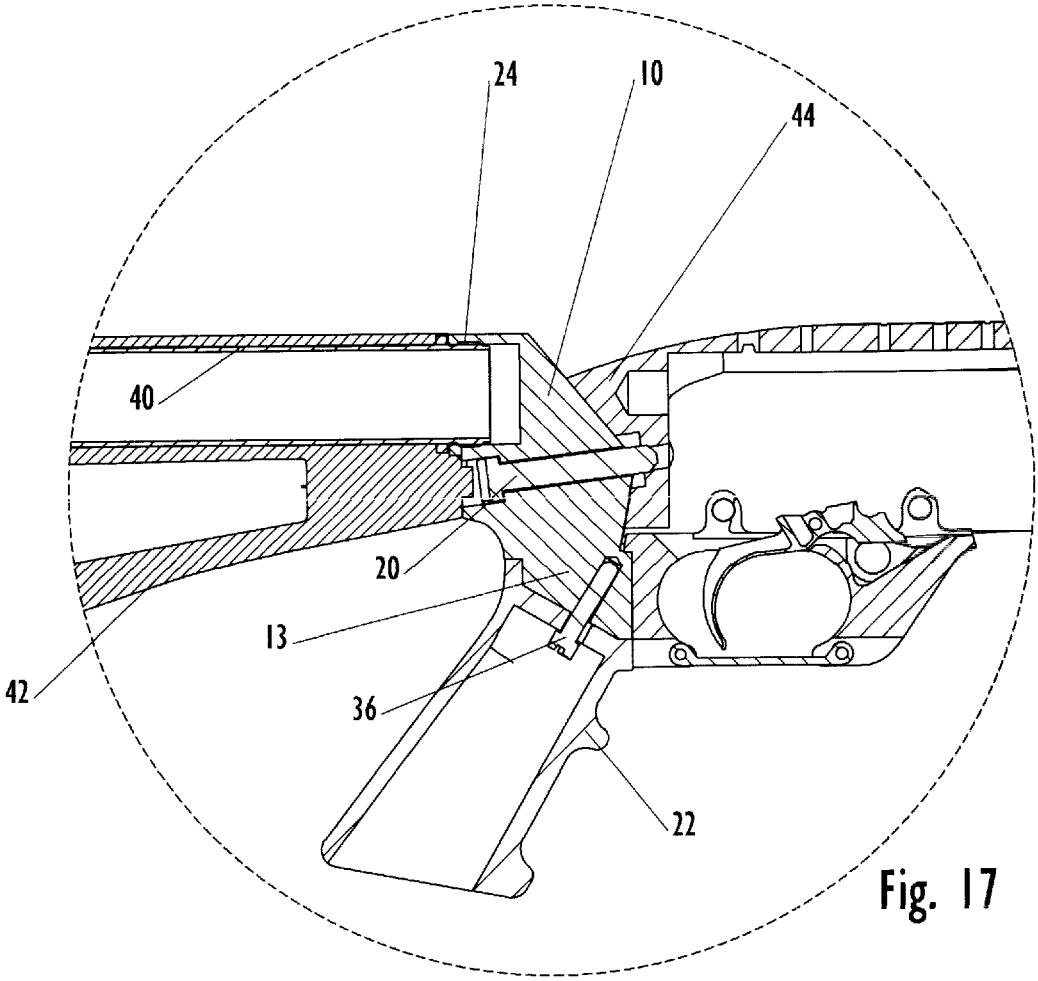
FIG. 17 is a detail view of a section of FIG. 16 referenced by number 17.

FIG. 15 is a back perspective view of a shotgun with a fixed buttstock assembly 38 of the M16/M4 style rifles and carbines and the subject of U.S. Pat. No. 3,618,248 threadably attached to receiver extension threaded bore 24. FIGS. 16 and 17 are cross-sectional side views of the shotgun shown in FIG. 15, with FIG. 17 a detail view of reference number 17 of FIG. 16. Shown is tubular receiver extension 40, which is a component of fixed buttstock assembly 38 that is threadably inserted within receiver extension threaded bore 24. Buttstock and pistol grip interface 10 is threadbly attached by fastener 20 to the back surface of a shotgun. Pistol grip 22 is shown to be threadably attached to pistol grip mounting flange 13 of buttstock and pistol grip interface 10 by pistol grip fastener 36. Fixed buttstock body 42 is shown to be slidably inserted upon tubular receiver extension 40 and approximating the back surface of buttstock and pistol grip interface 10.

Figure 18:
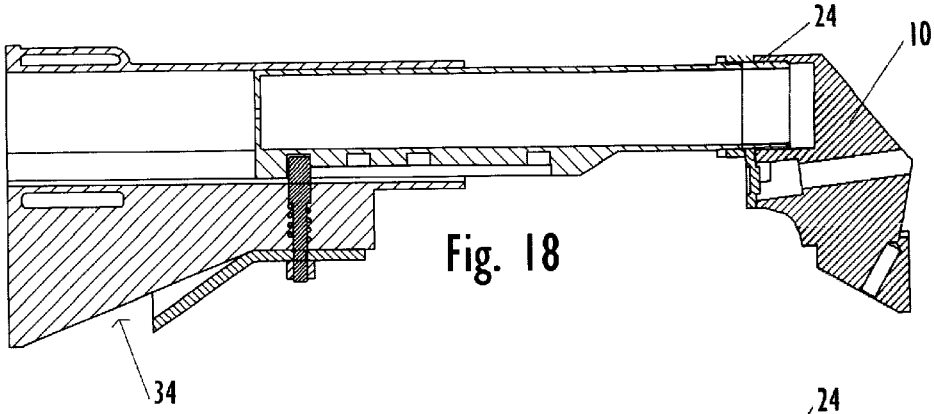
FIG. 18 is a cross-sectional side view of my invention with an adjustable buttstock assembly attached.
Figure 19:
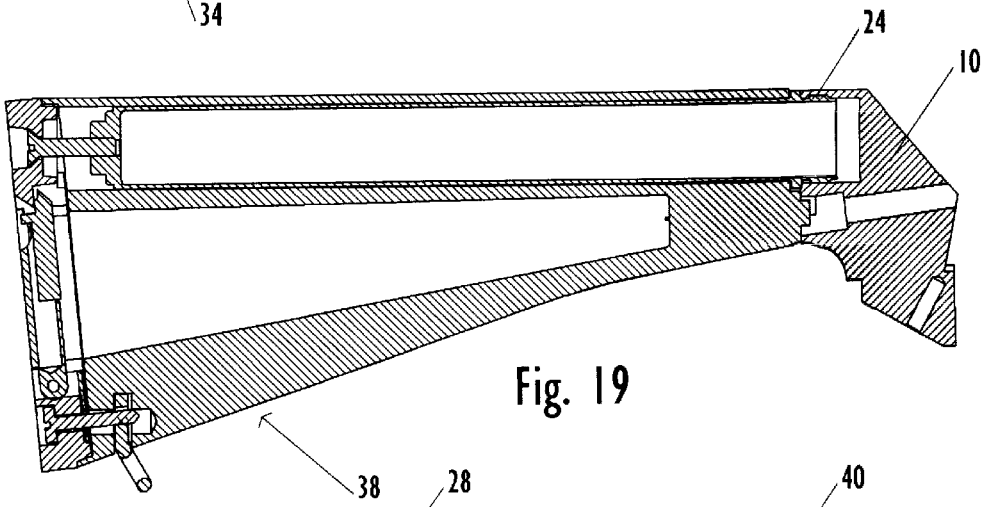
FIG. 19 is a cross-sectional side view of my invention with a fixed buttstock assembly attached.

FIG. 18 is a cross-sectional side view of adjustable buttstock assembly 34 threadably inserted within receiver extension threaded bore 24 of buttstock and pistol grip interface 10. FIG. 19 is a cross-sectional side view of fixed buttstock assembly 38 threadably inserted within receiver extension threaded bore 24 of buttstock and pistol grip interface 10.

Figure 20:
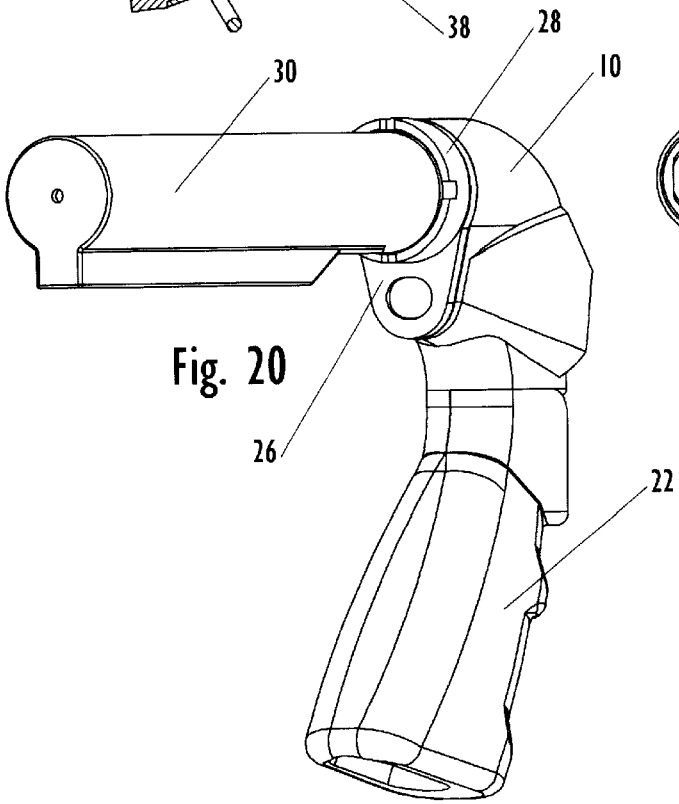
FIG. 20 is a rear perspective of my invention with an adjustable buttstock receiver extension attached.
Figure 21:
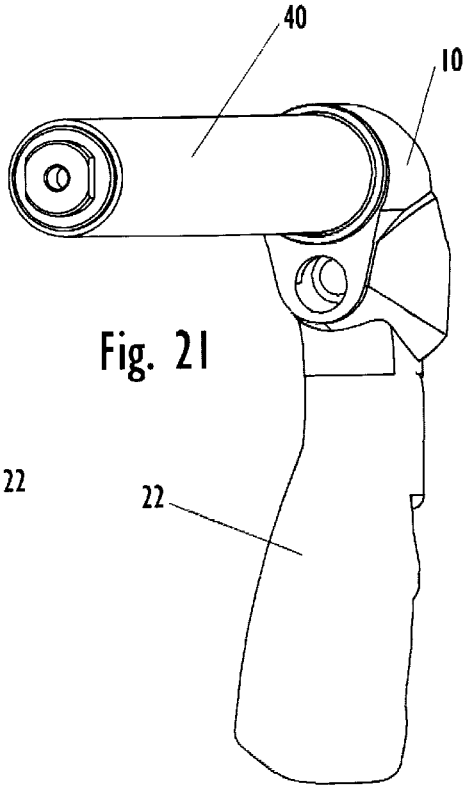
FIG. 21 is a rear perspective view of my invention with a fixed buttstock receiver extension attached.

FIG. 20 is a back perspective view of buttstock and pistol grip interface 10 with adjustable receiver extension 30 threadably inserted within receiver extension threaded bore 24 (not shown) of buttstock and pistol grip interface 10 located by receiver endplate 26, and secured by adjustable receiver extension locknut 28. Shown is pistol grip 22 which is attached to buttstock and pistol grip interface 10. FIG. 21 is a back perspective view of buttstock and pistol grip interface 10 with tubular receiver extension 40 threadably inserted within receiver extension threaded bore 24 (not shown) of buttstock and pistol grip interface 10. Also shown is pistol grip 22 which is attached to buttstock and pistol grip interface 10.

PREFERRED EMBODIMENT—OPERATION

Figure 4:
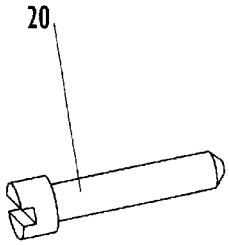
FIG. 4 is a perspective view of a buttstock and pistol grip interface fastener according to a preferred embodiment of my invention.

The preferred embodiment of the present invention shown in FIGS. 1–3 provides a buttstock and pistol grip interface 10 that allows a fastener 20 shown in FIG. 4 that can attach it to the rear surface of a firearm receiver. Shown is shotgun receiver 44 which is part of a shotgun assembly 46 as shown in FIG. 10. Affixed to said shotgun assembly 46 buttstock and pistol grip interface 10 allows a pistol grip 22, shown in FIG. 5 of the style commonly employed on M4/M16 style firearms to be attached with pistol grip fastener 36 shown in FIGS. 14, and 17, which threadably inserts within threaded bore 15 shown in FIGS. 2, 7, 14, 17, 18, and 19, of pistol grip mounting flange 13 shown in FIGS. 1, 2, 3, 6, 7, of buttstock and pistol grip interface 10, the object of the present invention. Said buttstock and pistol grip interface 10 also allows an adjustable receiver extension 30 shown in FIGS. 8, 12, 14, 18, and 20 of the M4/M16 family of firearms style which is tubular in configuration with an elongated rib 64 which extends radially outward from its bottom surface to be threadably attached to receiver extension threaded bore 24 of buttstock and pistol grip interface 10 as viewed in FIGS. 2, 5, and 7. FIGS. 11, 12, 13, 14, and 18 show adjustable buttstock assembly 34, with its adjustable receiver extension 30 threadably inserted within buttstock and pistol grip interface 10.

The buttstock and pistol grip interface 10 permits the attachment of an M16 style and variant thereof fixed buttstock tubular receiver extension 40 shown in FIGS. 9, 17, 19 and 21 used for a fixed buttstock assembly 38 with an internal stowage compartment as shown in FIGS. 9, 15, 17, and 19 as well as the previous described adjustable buttstock assembly 34.

The buttstock and pistol grip interface 10 allows a shotgun assembly 46 to utilize a pistol grip 22 and a military style buttstock assembly depicted by either adjustable buttstock assembly 34, and fixed buttstock assembly 38, as utilized by M4/M16 style firearms and variants.

Additionally the buttstock and pistol grip interface 10 allows the use of either a pistol grip 22 with a firearm, such as a shotgun assembly 46 without a buttstock, or an adjustable buttstock assembly 34, or fixed buttstock assembly 38 without a pistol grip.

CONCLUSIONS, RAMIFICATIONS, AND SCOPE

Accordingly, it can be seen that the buttstock and pistol grip interface of this invention for firearms, and shotguns in particular affords a great degree of utility and modularity to the configuration options available in the production and utilization of various firearms for various purposes.

Furthermore the buttstock and pistol grip interface of this invention has the additional advantages in that:

It involves only a buttstock and pistol grip interface and a means for fastening it to a firearm receiver; and It can allow a firearm configuration that can have a pistol grip configuration; or It can allow for a firearm configuration that has a military style of buttstock of either an adjustable buttstock assembly as found on an M4 style firearm, or a fixed buttstock with internal storage capability as found on an M16 style firearm; or It can allow a firearm with a pistol grip, and either a military style of buttstock of either an adjustable buttstock assembly, or a fixed buttstock with internal storage.

Although the description above contains many specificities, these should not be construed as limiting the scope of the invention but as merely providing illustrations of some of the presently preferred embodiments of this invention. Various other embodiments and ramifications are possible within it's scope. For example, The buttstock and pistol grip interface can be made from various materials to accommodate different requirements;

the buttstock and pistol grip interface can be made in configurations to fit different firearms;

the buttstock can be secured with various fastening means to different firearms; and the buttstock and pistol grip interface brings the functionality and options that are available to military style carbines and rifles to shotguns as well as other firearms which imparts a familiarity to the handling and use of these firearms for those that have military experience.

It will be apparent to those skilled in the art that many modifications and substitutions can be made to the preferred embodiment without departing form the spirit and scope of the invention.

Thus the scope of the invention should be determined by the appended claims and their legal equivalents, rather than by the examples given.

What is claimed is:

1. A combination of a buttstock, a pistol grip and an interface for a firearm, wherein:

a) said interface includes a first bore for receiving a first bolt for attaching said interface to a receiver of the firearm;

b) said interface includes a second threaded bore for receiving a second bolt to attach said pistol grip to said interface;

c) said interface includes a third threaded bore; and d) said buttstock includes a receiver extension having a threaded end secured to said third threaded bore.

2. The combination of claim 1, wherein said buttstock is adjustable in length.

3. The combination of claim 1, wherein said buttstock is fixed in length.

4. The combination of claim 1, wherein said buttstock is M4 style buttstock.

5. The combination of claim 1, wherein said buttstock is an M16 style buttstock.

6. The combination of claim 1, wherein:

a) said interface includes a mounting flange; and b) said pistol grip includes a recess for receiving said mounting flange.

7. The combination of claim 6, wherein said second threaded bore is disposed in said mounting flange.

8. The combination of claim 1, wherein said interface includes a first and second diagonal front surfaces.

9. A combination of a buttstock, a pistol grip, an interface and a shotgun, wherein:

a) said interface includes a first bore for receiving a first bolt to attach said interface to a receiver of said shotgun;

b) said interface includes a second threaded bore for receiving a second bolt to attach said pistol grip to said interface;

c) said interface includes a third threaded bore; and d) said buttstock includes a receiver extension having a threaded end secured to said third threaded bore.

10. The combination of claim 9, wherein said buttstock is adjustable in length.

11. The combination of claim 9, wherein said buttstock is fixed in length.

12. The combination of claim 9, wherein said buttstock is M4 style buttstock.

13. The combination of claim 9, wherein said buttstock is an M16 style buttstock.

14. The combination of claim 9, wherein:

a) said interface includes a mounting flange; and b) said pistol grip includes a recess for receiving said mounting flange.

15. The combination of claim 14, wherein said second threaded bore is disposed in said mounting flange.

16. The combination of claim 9, wherein:

a) said interface includes a first and second diagonal front surfaces; and b) said receiver includes third and fourth diagonal surfaces that mate with respective said first and second diagonal surfaces.

* * * * *